US008820914B2

(12) United States Patent
Boland et al.

(10) Patent No.: US 8,820,914 B2
(45) Date of Patent: Sep. 2, 2014

(54) CONTROL OF INK TEMPERATURES FOR RADIANT DRYING

(71) Applicants: Stuart J. Boland, Denver, CO (US); Larry M. Ernst, Longmont, CO (US); Scott Johnson, Erie, CO (US); William Edward Manchester, Erie, CO (US); David M Price, Loveland, CO (US); Casey E. Walker, Boulder, CO (US)

(72) Inventors: Stuart J. Boland, Denver, CO (US); Larry M. Ernst, Longmont, CO (US); Scott Johnson, Erie, CO (US); William Edward Manchester, Erie, CO (US); David M Price, Loveland, CO (US); Casey E. Walker, Boulder, CO (US)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 13/746,667

(22) Filed: Jan. 22, 2013

(65) Prior Publication Data

US 2014/0204136 A1 Jul. 24, 2014

(51) Int. Cl.

| | |
|---|---|
| ***B41J 2/01*** | (2006.01) |
| ***B41J 2/195*** | (2006.01) |
| ***B41J 29/38*** | (2006.01) |

(52) U.S. Cl.
USPC ..... 347/102; 347/6; 347/7

(58) Field of Classification Search
USPC ..... 347/6, 7, 21, 28, 100, 102
See application file for complete search history.

(56) References Cited

U.S. PATENT DOCUMENTS

| | | | | |
|---|---|---|---|---|
| 5,570,118 | A * | 10/1996 | Rezanka et al. | 347/43 |
| 6,149,327 | A | 11/2000 | Ward et al. | |
| 6,359,701 | B1 | 3/2002 | Yamada et al. | |
| 6,367,923 | B1 * | 4/2002 | Koitabashi | 347/101 |
| 6,428,143 | B2 * | 8/2002 | Irihara et al. | 347/43 |
| 6,709,082 | B2 | 3/2004 | Kaneko | |
| 6,840,596 | B2 | 1/2005 | Moto et al. | |
| 8,061,832 | B2 | 11/2011 | Gorbold et al. | |
| 8,152,261 | B2 | 4/2012 | Furuichi et al. | |
| 2001/0020964 | A1 | 9/2001 | Irihara et al. | |
| 2004/0085423 | A1 | 5/2004 | Bronstein et al. | |
| 2010/0304028 | A1 * | 12/2010 | Sowinski et al. | 427/256 |
| 2011/0199416 | A1 | 8/2011 | Takahashi et al. | |

OTHER PUBLICATIONS

A. S. Ink & Chemical Co., Ltd. Blistering. Trouble shooting. Retrieved from http://www.asink.com/htm/troblue-blistering.htm.

* cited by examiner

*Primary Examiner* — Hai C Pham
(74) *Attorney, Agent, or Firm* — Duft Bornsen & Fettig LLP

(57) ABSTRACT

Systems and methods for tuning Key (K) black ink printed by a production printer. In one embodiment, an ink tuning system is implemented in a printing system. The printing system includes a production printer that is operable to print color ink onto a continuous-form medium, and includes a radiant dryer that is operable to dry the ink that is applied to the medium. The ink tuning system identifies areas of K black ink designated for printing on the medium by the production printer, and applies a liquid agent to the areas of K black ink to increase the liquid mass of the K black ink before the medium enters the radiant dryer.

18 Claims, 5 Drawing Sheets

CONTROL OF INK TEMPERATURES FOR RADIANT DRYING

FIELD OF THE INVENTION

The invention relates to the field of production printing and, in particular, to radiant drying of ink applied to a medium.

BACKGROUND

Businesses or other entities having a need for volume printing typically purchase a production printer. A production printer is a high-speed printer used for volume printing, such as 100 pages per minute or more. The production printers are typically continuous-form printers that print on paper or some other printable medium that is stored on large rolls.

A production printer typically includes a localized print controller that controls the overall operation of the printing system, and a print engine (sometimes referred to as an "imaging engine" or as a "marking engine"). The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. The printhead array is formed from multiple printheads that are spaced in series along a particular width so that printing may occur across the width of the medium.

When in operation, the printable medium is passed underneath the printhead arrays while the nozzles of the printheads discharge ink at particular intervals to form pixels on the medium. Some of the media used in inkjet printers is better suited to absorb the ink, while others are not. Thus, a radiant dryer may be installed downstream from the printhead array. The radiant dryer assists in drying the ink on the medium after the medium leaves the printhead array. A typical radiant dryer includes an array of lamps that emit light and heat. The light and heat from the lamps helps to dry the ink as the medium passes through the dryer.

Some production printers are able to print multiple colors, such as CMYK. CMYK is a color model that uses four colors of ink: Cyan, Magenta, Yellow, and Key (black). Key (K) black ink can cause problems when radiant dryers are installed downstream from a printhead array. The black ink absorbs significantly more radiant energy per volume from the dryer, so it dries faster than the other colors. If the black ink dries too fast, it can begin to burn or scorch on the medium while the other colors are not yet dry. This can unfortunately ruin the printed output on the medium, and can even ignite fires within the dryer.

SUMMARY

Embodiments described herein control the drying of (K) black ink by applying a liquid agent on the medium to areas of K black ink before the medium reaches the radiant dryer. The liquid agent adds liquid mass to the K black ink so that the drying rate of the K black ink is reduced within the radiant dryer. The areas of K black ink should dry more uniformly with other ink colors (e.g., C, M, and Y) that are also printed on the medium. Thus, the areas of K black ink are less likely to scorch in the radiant dryer before the other colors are sufficiently dry.

One embodiment comprises an ink tuning system implemented in a printing system. The printing system includes a production printer that is operable to print color ink onto a continuous-form medium, and includes a radiant dryer that is operable to dry the ink that is applied to the medium by the production printer. The ink tuning system is configured to identify areas of K black ink designated for printing on the medium by the production printer, and to apply a liquid agent to the areas of K black ink. The liquid agent increases the liquid mass of the K black ink before the medium enters the radiant dryer. Therefore, the mixture of the K black ink and the liquid agent (referred to as modified K black ink) will take longer to dry than K black ink itself. The modified K black ink may thus dry at a substantially similar rate to the other ink colors.

In another embodiment, the ink tuning system includes a reservoir configured to contain the liquid agent, an application mechanism configured to spray the liquid agent onto the medium, and a controller configured to identify the areas of K black ink, and to control the application mechanism to spray the liquid agent from the reservoir onto the areas of K black ink.

In another embodiment, the ink tuning system comprises a printhead assembly installed in the production printer in addition to printhead assemblies used for applying the color ink.

In another embodiment, the liquid agent comprises water, or a solution of water and other humectants such as glycol or glycerin.

In another embodiment, the ink tuning system is further configured to overlay the liquid agent onto the areas of K black ink that were already applied by the production printer.

In another embodiment, the ink tuning system is further configured to underlay the liquid agent onto the medium in the areas of K black ink that will be applied by the production printer.

In another embodiment, the ink tuning system is further configured to adjust the amount of liquid agent to apply to an area of K black ink based on an amount of K black ink applied to the area.

In another embodiment, the ink tuning system is further configured to adjust the amount of liquid agent to apply based on a power level being used within the radiant dryer.

Another embodiment comprises a method of tuning K black ink in a printing system. The method includes identifying areas of K black ink designated for printing on the medium by the production printer, and applying a liquid agent to the areas of K black ink to increase the liquid mass of the K black ink before the medium enters a radiant dryer.

Another embodiment comprises a production printer comprising a print controller operable to receive a print job, to process the print job to generate bitmaps for each of Cyan (C), Magenta (M), Yellow (Y), and Key (K) black, and to generate an ink tuning bitmap based on the K black bitmap that indicates pixel locations where K black ink will be printed. The production printer further includes a print engine operable to receive the C, M, Y, and K black bitmaps from the print controller, and to apply the C, M, Y, and K black ink onto a continuous-form medium based on the C, M, Y, and K black bitmaps. The production printer further includes an ink tuning system operable to receive the ink tuning bitmap from the printer controller, and to apply a liquid agent to the medium on the pixel locations where the print engine applies the K black ink. The liquid agent increases the liquid mass of the K black ink to lower the temperature of the K black ink when the medium is transferred to a radiant dryer.

The invention may include other exemplary embodiments described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
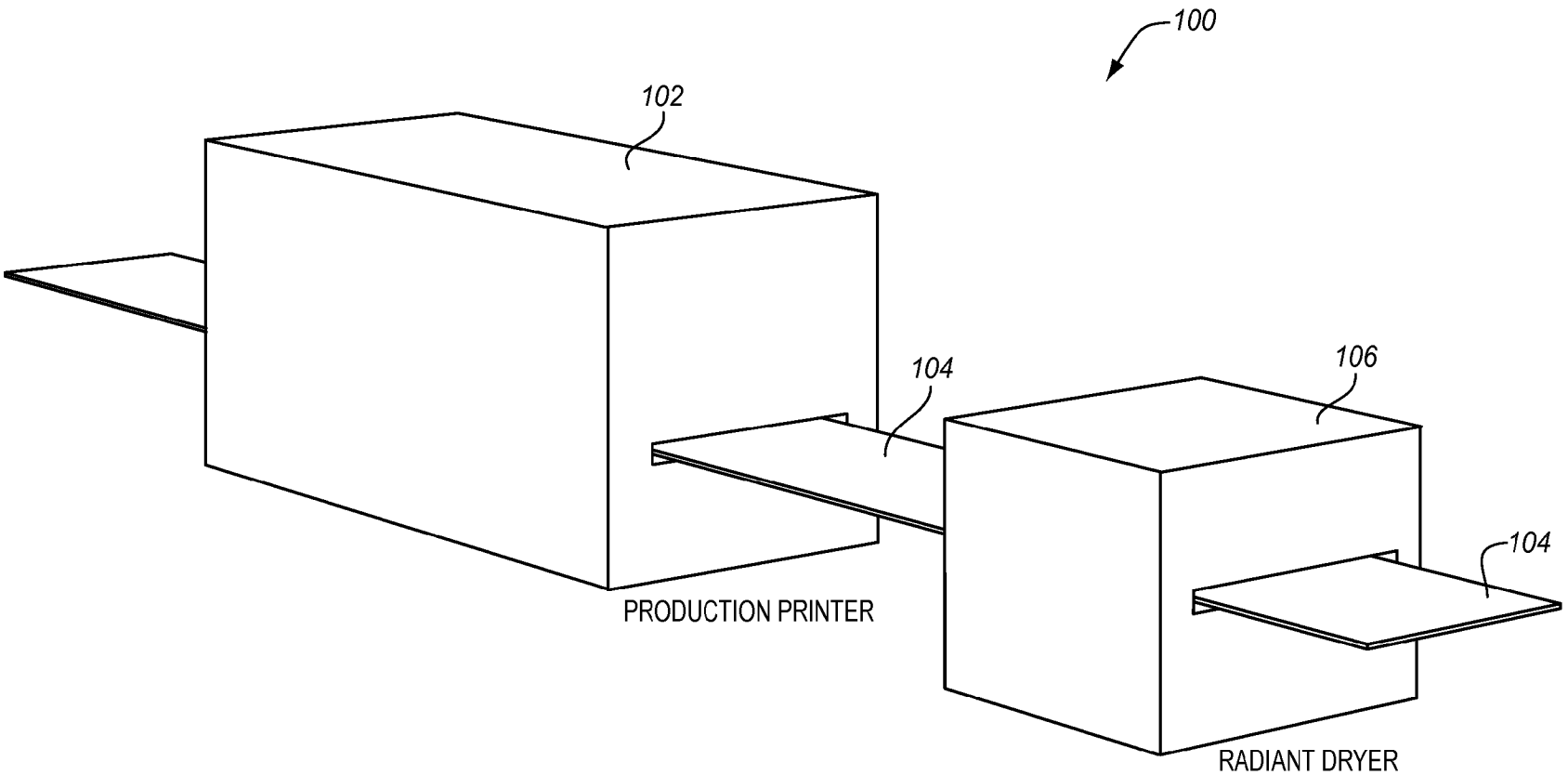
FIG. 1 illustrates a printing system.

FIG. 1 illustrates a printing system 100. Printing system 100 includes a production printer 102 that is operable to print onto a continuous-form medium 104. A production printer is a high-speed printer that is used for volume printing. The printing speed of production printers can reach 200 linear feet per minute or more. Printer 102 is able to apply color ink to medium 104, such as Cyan (C), Magenta (M), Yellow (Y), and Key (K) black.

Printing system 100 also includes a radiant dryer 106. Radiant dryer 106 is a unit or module installed in printer 102 or downstream from printer 102. After printer 102 applies ink to medium 104, the ink applied to medium 104 is still wet when it leaves printer 102. Thus, medium 104 travels through radiant dryer 106 where an array of light bulbs (not shown) radiate Near-Infrared (NIR) energy to dry the ink on medium 104.

A problem may occur when medium 104 travels through radiant dryer 106. K black ink absorbs more radiant energy than the other color inks. When the term "K black" is used herein, it refers to pure K black as opposed to a process black, which is a mixture of K black and other colors. Because K black ink absorbs more radiant energy than the other color inks, the K black ink will reach a higher temperature than the other color inks, and will dry at a faster rate than the other color inks. The temperature an ink reaches while drying in radiant dryer 106 is referred to herein as a "drying temperature". The rate at which an ink dries in radiant dryer 106 is referred to herein as a "drying rate".

Figure 2:
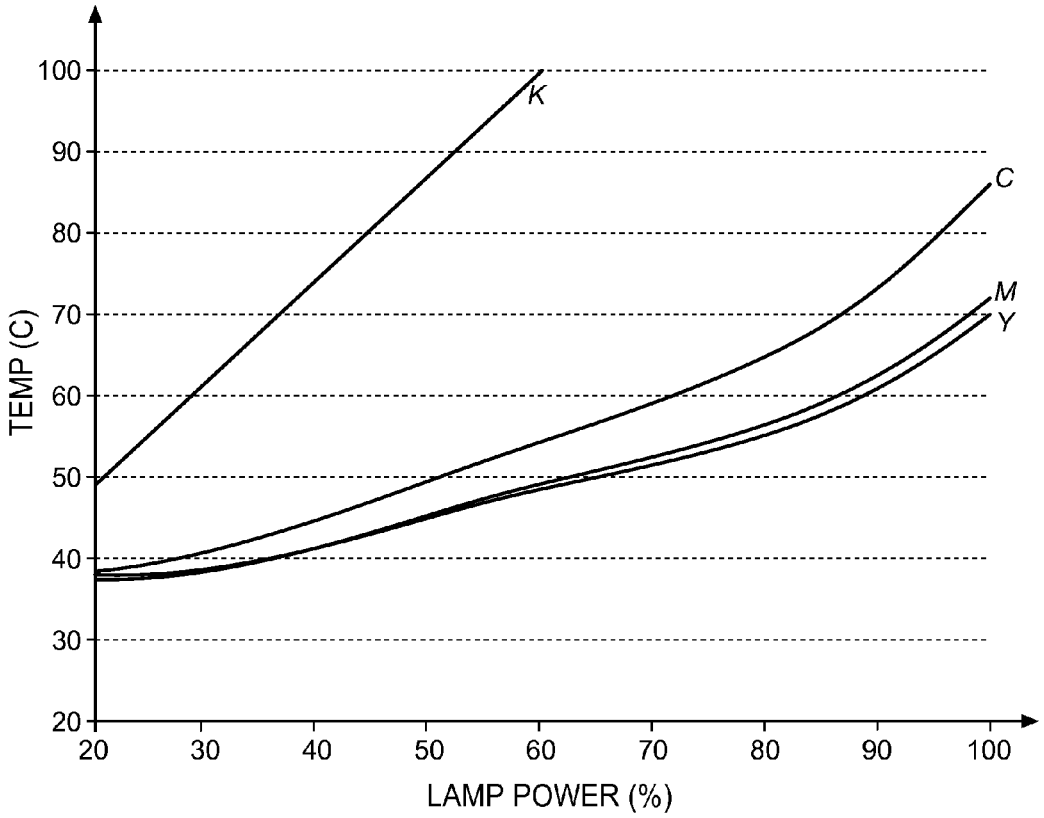
FIG. 2 is a graph illustrating the drying temperatures of different color inks.

FIG. 2 is a graph illustrating the drying temperatures of different color inks. The graph illustrates the drying temperatures of C, M, Y, and K black as a function of lamp power downstream from radiant dryer 106. For this graph, the temperatures would be measured some distance downstream of dryer 106, so the ink temperature can be much higher during the drying process. As the lamp power increases, the graph shows that the drying temperatures of C, M, and Y ink tend to increase gradually by the same amount. For example, at 50% lamp power, the drying temperatures of C, M, and Y ink are each about 50 degrees Celsius. The drying temperatures of K black ink are much higher than the other ink colors. As the lamp power increases, the drying temperature of K black ink increases a greater amount than the other color inks. For example, at 50% lamp power, the drying temperature of K black ink is about 85 degrees Celsius. Thus, the K black ink will dry at much higher temperatures than the other ink colors in radiant dryer 106, and will dry at a faster rate.

Because K black ink absorbs more radiant energy and dries at a faster rate, there is a risk that the K black ink will burn or scorch on medium 104 when passed through radiant dryer 106. To prevent this situation, printing system 100 is enhanced in the following embodiments to "tune" the K black ink that is printed on medium 104 before it reaches radiant dryer 106. As an overview, a liquid agent (e.g., water) is sprayed on medium 104 in the same or substantially same locations as the K black ink. The liquid agent mixes with the K black ink on medium 104 so that the mixture will dry at a lower temperature and at a slower rate than K black ink itself. The mixture of K black ink and liquid agent has a drying temperature and drying rate that is closer to the other ink colors. Therefore, the ink colors should dry more uniformly in radiant dryer 106.

Figure 3:
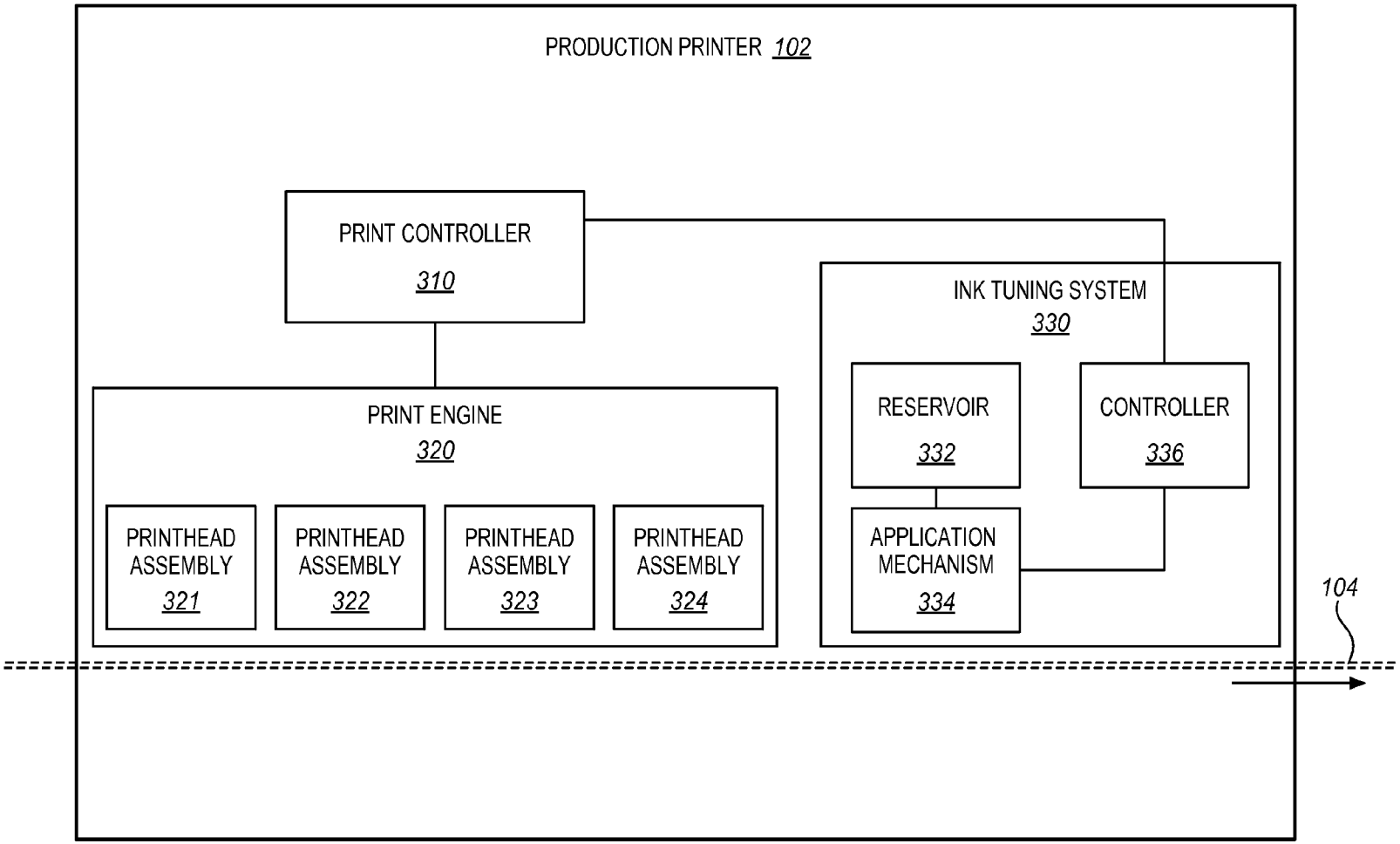
FIG. 3 is a schematic diagram of a production printer in an exemplary embodiment.

FIG. 3 is a schematic diagram of production printer 102 in an exemplary embodiment. Production printer 102 includes a print controller 310 and a print engine 320. Print controller 310 comprises a processing unit that receives a print job from a host system, such as in a Page Description Language (PDL), and translates the print job into a raster image that print engine 320 is able to print. The raster image may also be referred to as a bitmap. Print engine 320 includes a plurality of printhead assemblies 321-324. Each printhead assembly 321-324 includes an ink reservoir, a printhead controller, and one or more printheads (not shown). In this embodiment, one of the printhead assemblies is operable to print K black ink, and the other printhead assemblies are operable to print inks of other colors, such as C, M, and Y. The printhead controller for each color receives a bitmap from print controller 310, and controls the nozzles of the printhead to spray ink in the pixel locations indicated in the bitmap.

Production printer 102 in this embodiment also includes an ink tuning system 330. Ink tuning system 330 is a unit or module installed in printer 102 (or outside of printer 102) to "tune" the K black ink that is applied to medium 104. The purpose of tuning the K black ink is to lower the drying temperature and/or drying rate of the K black ink before medium 104 reaches radiant dryer 106. In this embodiment, ink tuning system 330 includes a reservoir 332, an application mechanism 334, and a controller 336. Reservoir 332 comprises any container that is able to store a liquid. In this embodiment, the liquid comprises an aqueous solution that is able to mix with K black ink, which is water-based. The aqueous solution is referred to herein as a "liquid agent", because it is able to mix with the K black ink to produce the effect of lower drying temperatures/rates. Application mechanism 334 comprises any device that is able to spray or apply the liquid agent onto medium 104. Application mechanism 334 may resemble a printhead that is used to spray ink onto medium 104. Controller 336 comprises any unit that is able to control where application mechanism 334 sprays the liquid agent onto medium 104. Although controller 336 is shown as a separate element in FIG. 3, the functions for controller 336 may be performed by print controller 310.

In one exemplary implementation, ink tuning system 330 may be installed as an extra printhead assembly within production printer 102. Production printers that print four colors may have a printhead assembly for each color (or a printhead assembly may print multiple colors). For instance, for K black, a printhead assembly may include a reservoir for the K black ink, a printhead (or array of printheads) for spraying the K black ink, and a printhead controller for controlling the printhead based on a bitmap. Most production printers allow for many printhead assemblies to be installed. Therefore, an additional printhead assembly may be added to production printer 102 for ink tuning system 330. For this implementation, reservoir 332 comprises the reservoir of the additional printhead assembly, application mechanism 334 comprises a printhead (or array of printheads) of the additional printhead assembly, and controller 336 comprises the printhead controller of the additional printhead assembly (or print controller 310). Implementing ink tuning system 330 as an additional printhead assembly is just one embodiment, as ink tuning system 330 can be installed in many different ways.

Figure 4:
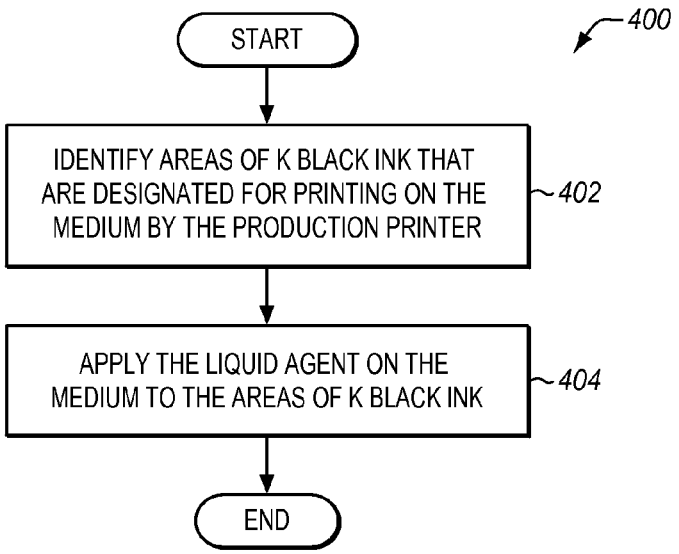
FIG. 4 is a flow chart illustrating a method of tuning K black ink in an exemplary embodiment.

FIG. 4 is a flow chart illustrating a method 400 of tuning K black ink in an exemplary embodiment. The steps of method 400 will be described with reference to ink tuning system 330 in FIG. 3, although method 400 may be performed in other systems. The steps of the flow chart described herein are not all inclusive and may include other steps not shown. The steps may also be performed in an alternative order.

In step 402, ink tuning system 330 identifies areas of K black ink that are designated for printing on medium 104 by print engine 320 of production printer 102. An area of K black ink is defined as a location or position on medium 104 where K black ink is printed or will be printed. For example, if there is text being printed on medium 104 with K black ink, then an "area" identified by ink tuning system 330 is the area or position where the text characters are printed or will be printed. In another example, if there is an image printed with K black ink, then the "area" identified by ink tuning system 330 is the area or position where the image is printed or will be printed. The areas identified by ink tuning system 330 are areas where K black only is applied.

In step 404, ink tuning system 330 applies the liquid agent on medium 104 to the areas of K black ink. The liquid agent applied by ink tuning system 330 mixes with the K black ink to increase the liquid mass of the K black ink. Some examples of the liquid agent include water, a solution of water and a humectant such as glycol, or another type of aqueous solution. The mixture of the K black ink and the liquid agent is referred to herein as "modified K black ink". With the liquid mass of the modified K black ink increased, it will take more radiant energy to cause a phase change in the modified K black ink from a liquid to a vapor. Therefore, the drying rate of the modified K blank ink is reduced. Also, the drying temperature of the modified K black ink will be lower than pure K black ink because of the additional liquid mass.

Figure 5:
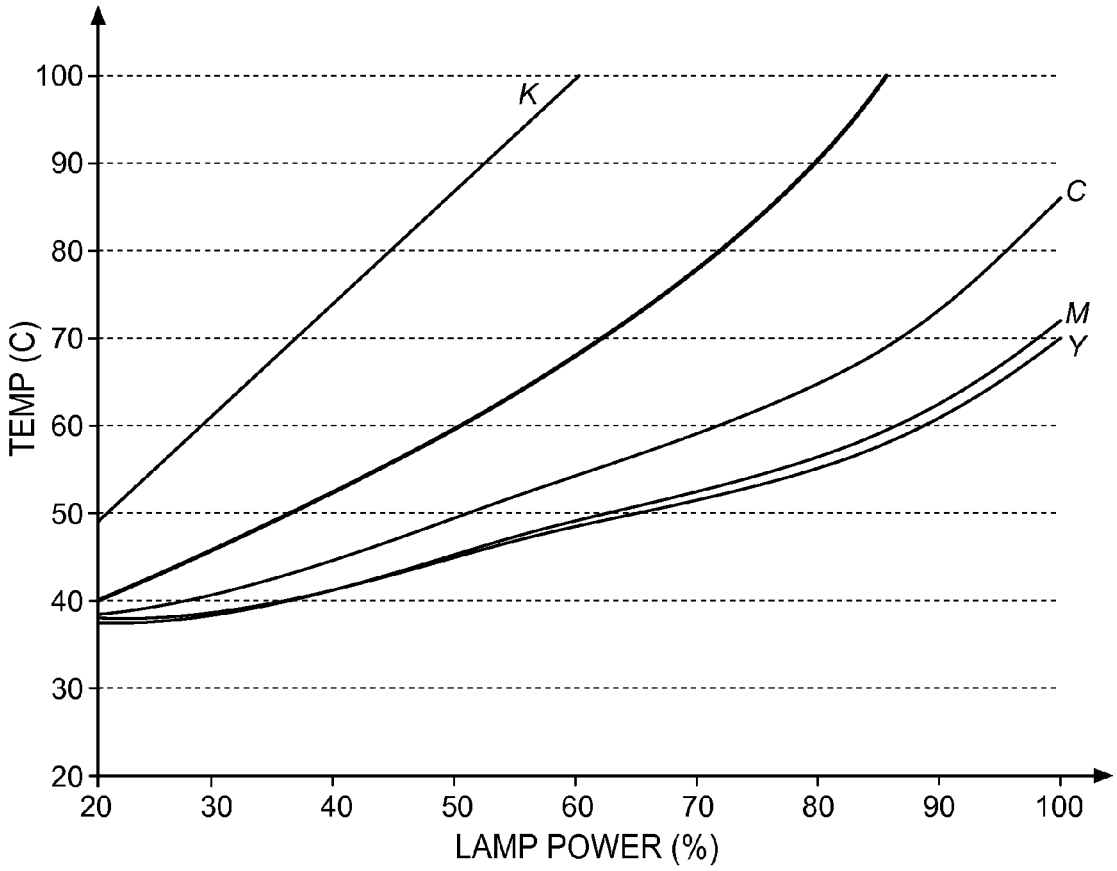
FIG. 5 is a graph illustrating the drying temperatures of modified K black ink in an exemplary embodiment.

FIG. 5 is a graph illustrating the drying temperatures of modified K black ink in an exemplary embodiment. The graph illustrates the drying temperatures of C, M, Y, K black, and modified K black as a function of lamp power downstream of radiant dryer 106. As is evident in FIG. 5, the drying temperatures of modified K black are lower than the drying temperatures of K black. For example, at 50% lamp power, the drying temperature of modified K black ink is about 60 degrees Celsius, while the drying temperature of K black ink is about 85 degrees Celsius. Thus, the modified K black ink will dry at a slower rate than K black ink itself, and the drying temperature of modified K black ink more closely resembles the drying temperatures of the other ink colors.

Ink tuning system 330 may apply the liquid agent as an overlay on K black ink that has already been applied on medium 104. For example, a printhead may first apply the K black ink on medium 104, and then ink tuning system 330 may apply the liquid agent on top of the K black ink. Alternatively, ink tuning system 330 may apply the liquid agent as an underlay where K black ink will be applied on medium 104. For example, ink tuning system 330 may first apply the liquid agent on medium 104 in areas where K black ink will be applied, and then a printhead may apply the K black ink on top of the liquid agent.

Ink tuning system 330 may also vary the amount of liquid agent that is applied to an area of K black ink. In one embodiment, ink tuning system 330 may adjust the amount of liquid agent applied to medium 104 based on an amount of K black ink that is applied or will be applied to an area. For example, if the character "A" is being printed by itself on a page, then ink tuning system 330 may determine that little or no liquid agent needs to be applied to this area because the amount of K black ink used to print this character is low. Even though the character is printed with K black ink, the small amount of ink used to print the character will not absorb a large amount of radiant energy from radiant dryer 106. Thus, the risk of scorching the K black ink for this character is low. Alternatively, if a large image is being printed on a page with K black ink, then ink tuning system 330 may determine that a larger amount of liquid agent needs to be applied to this area because the amount of K black ink used to print this image is high. The large amount of ink used to print the image will absorb a large amount of radiant energy from radiant dryer 106. Thus, the risk of scorching the K black ink for the image is higher.

In another embodiment, ink tuning system 330 may adjust the amount of liquid agent applied to medium 104 based on a power level being used within radiant dryer 106. For example, if the power levels are lower in radiant dryer 106, then ink tuning system 330 may determine that little or no liquid agent needs to be applied. Looking at FIG. 5, at power levels between 20-30%, the drying temperature of K black ink is closer to the drying temperatures of C, M, and Y ink. Thus, ink tuning system 330 may determine that little or no liquid agent needs to be applied at these lower power levels. However, if the power levels are higher in radiant dryer 106, then ink tuning system 330 may determine that more liquid agent needs to be applied. Looking again at FIG. 5, at power levels of 50% or more, the drying temperature of K black ink is much higher than the drying temperatures of C, M, and Y ink. Thus, ink tuning system 330 may determine that more liquid agent needs to be applied at these higher power levels.

In order to allow ink tuning system 330 to identify the areas where K black (only) is printed or will be printed, print controller 310 may also be enhanced (see FIG. 3) in the following embodiment. As stated above, when print controller 310 receives a print job, it processes the job (i.e., RIPs or rasterizes) to generate bitmaps for each of C, M, Y, and K black. Print controller 310 then sends these bitmaps to print engine 320 for printing. In addition to generating the C, M, Y, and K bitmaps, print controller 310 may also generate an ink tuning bitmap for ink tuning system 330. The ink tuning bitmap indicates areas on a page or sheetside where K black will be printed. Print controller 310 may make a copy of the K black bitmap to generate the ink tuning bitmap, or may otherwise process the K black bitmap to generate the ink tuning bitmap. Ink tuning system 330 then applies the liquid agent to medium 104 based on the ink tuning bitmap. For example, ink tuning system 330 may apply the liquid agent on the pixel locations where print engine 320 applies the K black ink. The actual resolution of ink tuning system 330 may depend on desired implementations. For instance, ink tuning system 330 may apply a "pixel" of liquid agent for each pixel of K black ink that is applied or will be applied to medium 104. If ink tuning system 330 is not capable of pixel-level resolution, then ink tuning system 330 may approximate the areas of K black ink on medium 104 based on the ink tuning bitmap.

In summary, the addition of a liquid agent to K black ink changes the liquid content of the K black ink. With the liquid content changed, the mixture of K black ink and the liquid agent will dry at a slower rate in radiant dryer 106 than K black ink itself. The addition of the liquid agent to the K black ink compensates for the differences in drying rates between K black and the other ink colors. Therefore, the mixture of K black ink and the liquid agent should dry at about the same time as the other ink colors. This substantially reduces the risk that K black ink will burn in radiant dryer 106 while the other ink colors are not yet dry.

Figure 6:
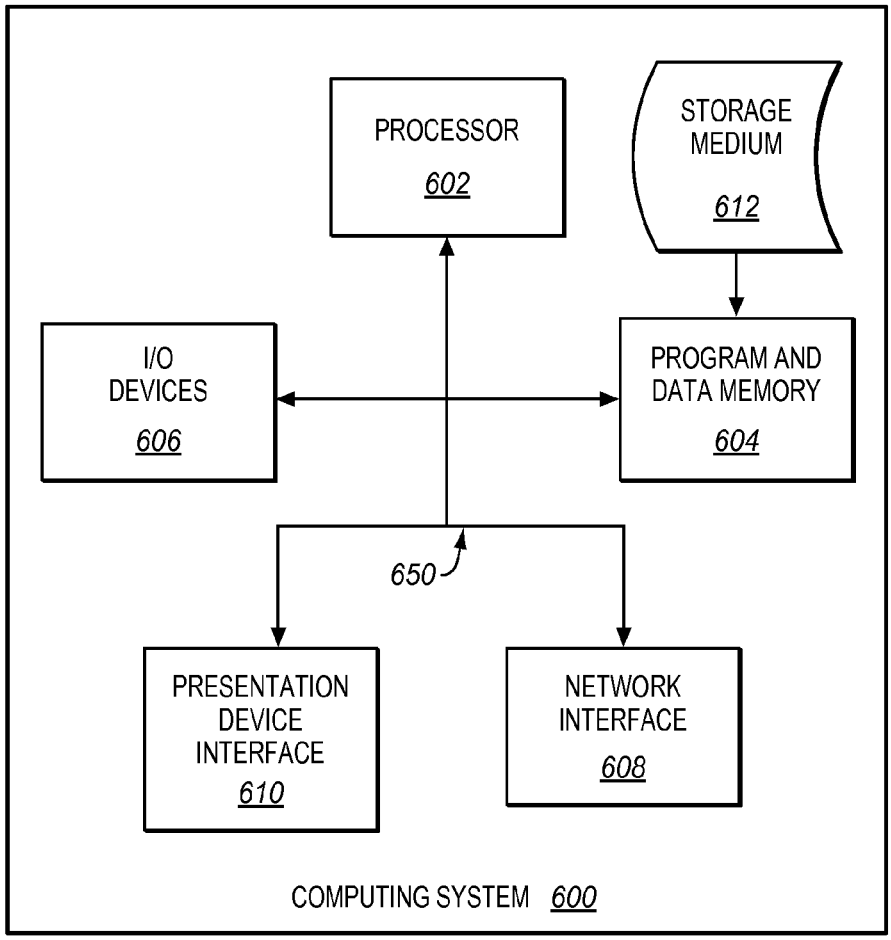
FIG. 6 illustrates a computing system in an exemplary embodiment.

The controllers described herein can take the form of an entirely hardware embodiment, an entirely software embodiment or an embodiment containing both hardware and software elements. In one embodiment, the controllers may be implemented in software, which includes but is not limited to firmware, resident software, microcode, etc. FIG. 6 illustrates a computing system 600 in an exemplary embodiment.

Furthermore, the invention can take the form of a computer program product accessible from a computer-usable or computer-readable medium 612 providing program code for use by or in connection with a computer or any instruction execution system. For the purposes of this description, a computer-usable or computer readable medium 612 can be any apparatus that can contain, store, communicate, or transport the program for use by or in connection with the instruction execution system, apparatus, or device.

The medium 612 can be an electronic, magnetic, optical, electromagnetic, infrared, or semiconductor system (or apparatus or device) or a propagation medium. Examples of a computer-readable medium 612 include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 602 coupled directly or indirectly to memory 604 through a system bus 650. The memory 604 can include local memory employed during actual execution of the program code, bulk storage, and cache memories which provide temporary storage of at least some program code in order to reduce the number of times code is retrieved from bulk storage during execution.

Input/output or I/O devices 606 (including but not limited to keyboards, displays, pointing devices, etc.) can be coupled to the system either directly or through intervening I/O controllers, as can a presentation device interface (I/F) 610.

Network adapters may also be coupled to the system to enable the data processing system to become coupled to other data processing systems, such a through network interfaces 608, or remote printers or storage devices through intervening private or public networks. Modems, cable modem and Ethernet cards are just a few of the currently available types of network adapters.

Although specific embodiments were described herein, the scope of the invention is not limited to those specific embodiments. The scope of the invention is defined by the following claims and any equivalents thereof.

We claim:

1. An apparatus comprising:

an ink tuning system implemented in a printing system, wherein the printing system includes a production printer that is operable to print color ink onto a continuous-form medium, and includes a radiant dryer that is operable to dry the ink that is applied to the medium by the production printer;

the ink tuning system is configured to identify areas of Key (K) black ink designated for printing on the medium by the production printer, and to apply a liquid agent to the areas of K black ink to increase the liquid mass of the K black ink before the medium enters the radiant dryer so that a mixture of the K black ink and the liquid agent dries at a lower rate;

the ink tuning system is further configured to adjust the amount of liquid agent to apply based on a power level being used within the radiant dryer.

2. The apparatus of claim 1 wherein:

the ink tuning system includes:

a reservoir configured to contain the liquid agent;

an application mechanism configured to spray the liquid agent onto the medium; and a controller configured to identify the areas of K black ink, and to control the application mechanism to spray the liquid agent from the reservoir onto the areas of K black ink.

3. The apparatus of claim 2 wherein:

the ink tuning system comprises a printhead assembly installed in the production printer in addition to printhead assemblies used for applying the color ink.

4. The apparatus of claim 1 wherein:

the liquid agent comprises water.

5. The apparatus of claim 1 wherein:

the liquid agent comprises a solution of water and a humectant.

6. The apparatus of claim 1 wherein:

the ink tuning system is further configured to overlay the liquid agent onto the areas of K black ink that were already applied by the production printer.

7. The apparatus of claim 1 wherein:

the ink tuning system is further configured to underlay the liquid agent onto the medium in the areas of K black ink that will be applied by the production printer.

8. The apparatus of claim 1 wherein:

the ink tuning system is further configured to adjust the amount of liquid agent to apply to an area of K black ink based on an amount of K black ink applied to the area.

9. A method of tuning Key (K) black ink in a printing system, wherein the printing system includes a production printer that is operable to print color ink onto a continuous-form medium, and includes a radiant dryer that is operable to dry the ink that is applied to the medium by the production printer, the method comprising:

identifying areas of K black ink designated for printing on the medium by the production printer;

applying a liquid agent to the areas of K black ink; and adjusting the amount of liquid agent to apply to an area of K black ink based on a power level being used within the radiant dryer;

wherein the liquid agent increases the liquid mass of the K black ink before the medium enters the radiant dryer so that a mixture of the K black ink and the liquid agent dries at a lower rate.

10. The method of claim 9 wherein:

the liquid agent comprises water.

11. The method of claim 9 wherein:

the liquid agent comprises a solution of water and a humectant.

12. The method of claim 9 wherein applying a liquid agent on the medium to the areas of K black ink comprises:

overlaying the liquid agent onto the areas of K black ink that were already printed by the production printer.

13. The method of claim 9 wherein applying the liquid agent on the medium to the areas of K black ink comprises:

applying the liquid agent onto the medium in the areas of K black ink that will be printed by the production printer.

14. The method of claim 9 further comprising:

adjusting the amount of liquid agent to apply to an area of K black ink based on an amount of K black ink applied to the area.

15. An apparatus comprising:

a production printer comprising:

a print controller operable to receive a print job, to process the print job to generate bitmaps for each of Cyan (C), Magenta (M), Yellow (Y), and Key (K) black, and to generate an ink tuning bitmap based on the K black bitmap that indicates pixel locations where K black ink will be printed;

a print engine operable to receive the C, M, Y, and K black bitmaps from the print controller, and to apply the C, M, Y, and K black ink onto a continuous-form medium based on the C, M, Y, and K black bitmaps; and an ink tuning system operable to receive the ink tuning bitmap from the print controller, and to apply a liquid agent to the medium on the pixel locations where the print engine applies the K black ink, wherein the liquid agent increases the liquid mass of the K black ink to lower a drying temperature of the K black ink when the medium is transferred to a radiant dryer;

the ink tuning system is further operable to adjust the amount of liquid agent to apply based on a power level being used within the radiant dryer.

16. The apparatus of claim 15 wherein:

the ink tuning system comprises a printhead assembly installed in the print engine in addition to C, M, Y, and K black printhead assemblies used for applying the C, M, Y, and K black ink.

17. The apparatus of claim 15 wherein:

the ink tuning system is further configured to overlay the liquid agent onto the medium after the print engine applies the K black ink.

18. The apparatus of claim 15 wherein:

the ink tuning system is further configured to underlay the liquid agent onto the medium before the print engine applies the K black ink.

* * * * *